United States Patent [19]

Huntley

[11] 4,364,622

[45] Dec. 21, 1982

[54] CONNECTOR FOR FLAT CABLE

[75] Inventor: Ted R. Huntley, St. Paul, Minn.

[73] Assignee: Minnesota Mining and Manufacturing Company, St. Paul, Minn.

[21] Appl. No.: 148,222

[22] Filed: May 9, 1980

[51] Int. Cl.[3] ..... H01R 4/24

[52] U.S. Cl. ..... 339/97 R; 339/98

[58] Field of Search ..... 339/17 F, 176 RF, 97–99, 339/95 R, 95 D, 96

[56] References Cited

U.S. PATENT DOCUMENTS 4,023,883 5/1977 Raposa et al. ..... 339/98

4,258,974 3/1981 Kuo et al. ..... 339/97 R

*Primary Examiner*—Eugene F. Desmond

*Attorney, Agent, or Firm*—Cruzan Alexander; Donald M. Sell; Terryl K. Qualey

[57] ABSTRACT

Connections to one or more wires of a flat cable are made with connectors having contact elements each with two bifurcate contact members extending to different heights and at right angles to each other from a common base. One contact member contacts a wire of the cable. The other member penetrates the cable parallel to that wire and contacts a connecting wire. Cutting means for severing the cable wire may be included.

9 Claims, 17 Drawing Figures

CONNECTOR FOR FLAT CABLE

This invention relates to connectors and contact elements useful in making electrical connection to and between wires of flat cables.

Cables comprising a number of insulated copper wires held in parallel side-by-side arrangement have been found useful in the electrical wiring of such widely diverse devices as computers, communications apparatus, electric organs, cash registers and pinball machines. Color coding makes possible the selection of appropriate conductors at various points along the length of the cable while avoiding the confusion and delay experienced with bundles of loose wires.

Connectors for making connection to the conductors of flat cables have previously been described. U.S. Pat. No. 3,189,863, for example, employs bifurcate or U-shaped contact elements having opposed jaws, supported in an insulating body which is channeled to receive and position the cable. Contact may be made to all conductors simultaneously. If desired, contact may be restricted to one or more selected wires by removing the undesired contact elements. In modified form using double-ended contact elements, the connectors make possible the interconnecting of conductors from juxtaposed or intersecting cables.

In many applications it becomes necessary to make electrical contact with a single conductor of a flat cable. Thus a pinball machine circuit may require a connection to a light bulb, switch, or flipper control from a location on the cable at which no other contact is indicated. Again, it may be necessary to extend a single conductor well beyond the termination of all of the remaining conductors of the cable, for example to complete a ground connection. Use of a connector of U.S. Pat. No. 3,189,863 for such purposes, while effective, might be considered wasteful of materials; and therefore such connections have heretofore generally been made by tedious and intricate procedures involving hand separation of wires, removal of insulation, and solder connection of the needed extension wire at the indicated cable area.

The present invention makes available a connector with which effective electrical contact may be made to any indicated wire of a flat cable at any accessible point along the cable, by simple pressure application. In one aspect the invention provides for simultaneously breaking the wire and connecting external wires to the severed ends across the break. In another, there is provided a connector for interconnecting the conductors of two intersecting cables in a simplified manner.

These and other advantages and improvements are achieved primarily by means of a folded bi-level twin U-contact element wherein the two U-contacts are disposed at right angles to each other and with one extending at least a full wire-diameter above the other. An insulating base supports the element or elements and a protective insulating cover is provided for forcing the cable and wires toward the base and into electrical contact with the elements. In a preferred mode the base and cover are further provided with interacting cutting means for severing the cable conductor.

The invention will now be further described with reference to the accompanying drawings, wherein.

Figure 2:
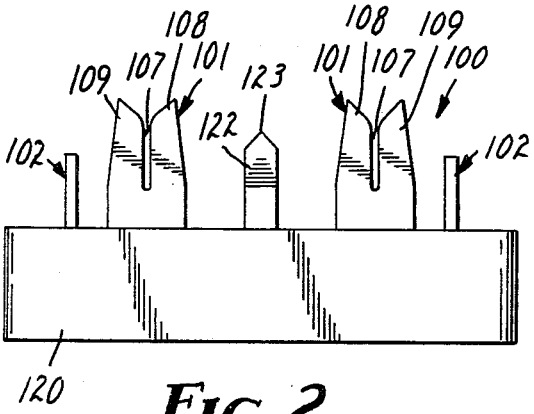
FIG. 2 is a side elevation and FIG. 3 an end elevation, of a connector base fitted with two of the contact elements of FIG. 1.
Figure 5:
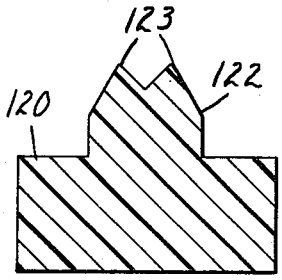
Figure 4:
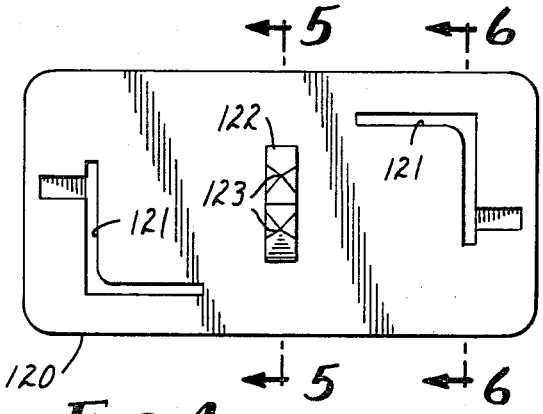
Figure 6:
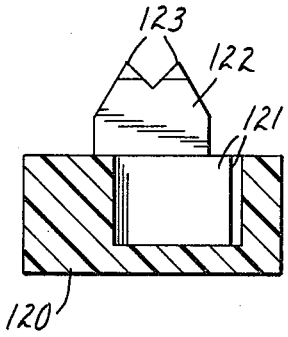
Figure 7:
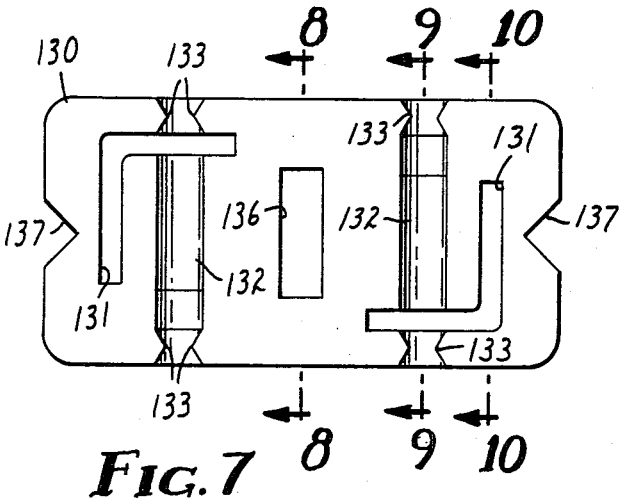
Figure 8:
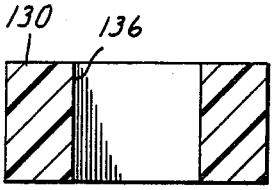
Figure 9:
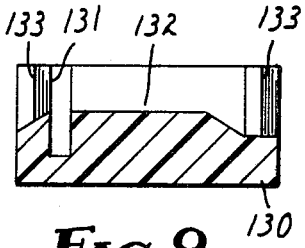
Figure 11:
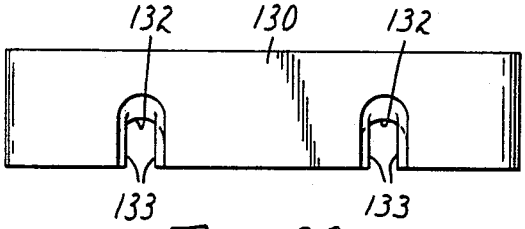
Figure 10:
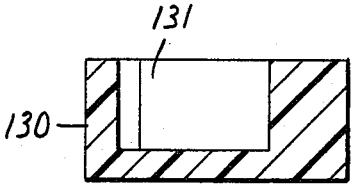
Figure 12:
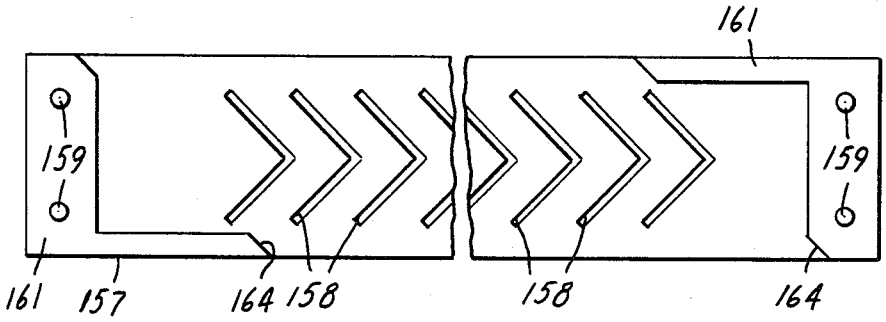
Figure 13:
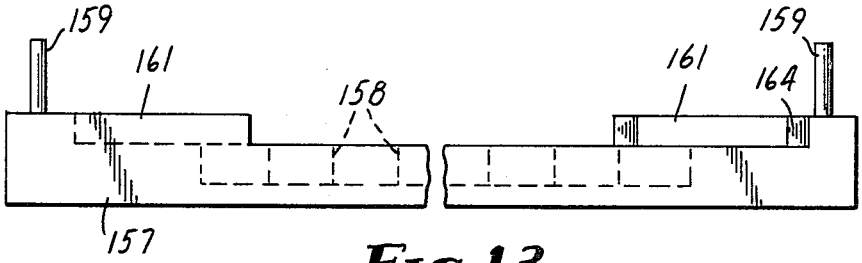

FIG. 4 is a top plan view of the insulating base of FIG. 2, and FIGS. 5 and 6 are sectional views taken at sections 5 and 6 of FIG. 4;

FIG. 7 is a bottom plan view of an insulating cover for the fitted base of FIG. 2, and FIGS. 8, 9 and 10 are sectional views taken at sections 8, 9 and 10 of FIG. 7;

FIG. 11 is a side elevation of the cover of FIG. 7;

FIG. 12 is a top plan view of a cable T-connector base;

FIG. 13 is a side elevation, and

Figure 15:
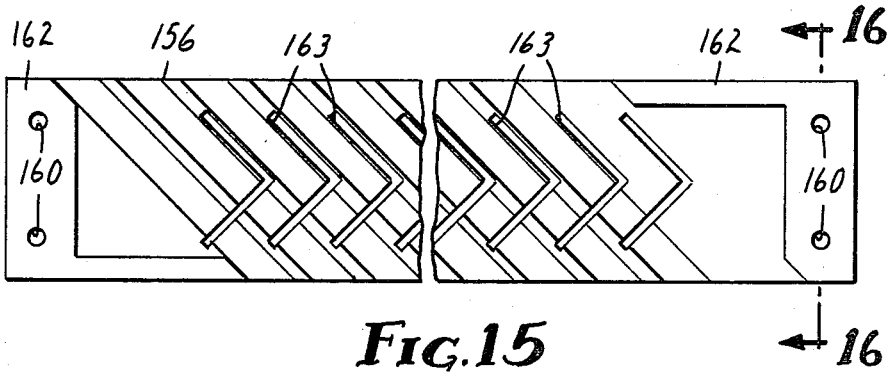
Figure 14:
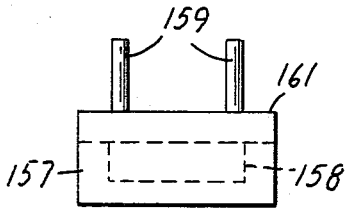

FIG. 14 is an end elevation of the base of FIG. 12;

FIG. 15 is a bottom plan view of a cover for the base of FIG. 12, and

Figure 17:
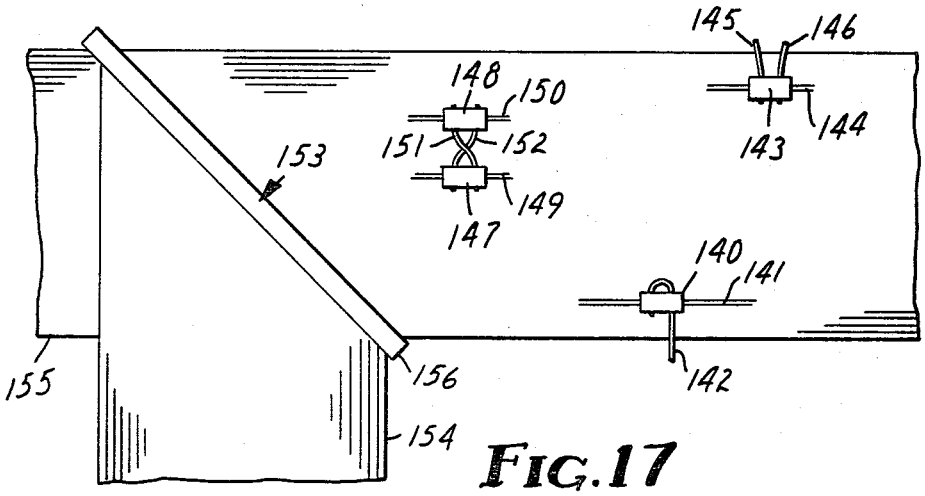
Figure 16:
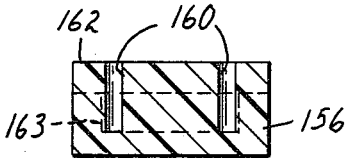

FIG. 16 is a sectional view of the cover at section 16 of FIG. 15; and FIG. 17 is a schematic illustration showing connectors of the invention applied to a flat cable.

Figure 1:
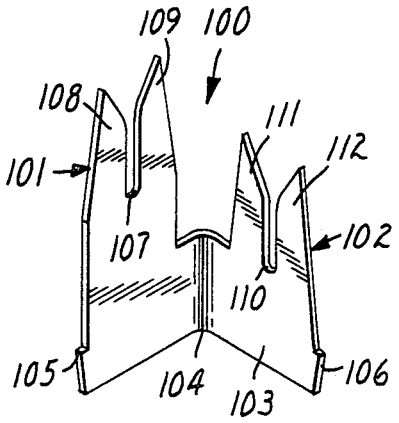
FIG. 1 is a view in perspective of a folded bi-level twin U-contact element, on a greatly enlarged scale.
Figure 3:
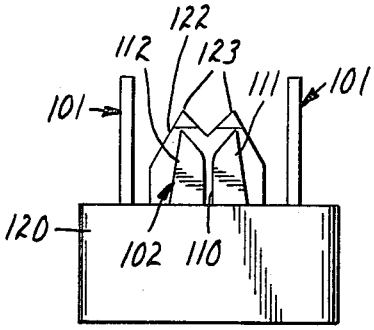

The contact elements 100 of FIG. 1 includes, in the position illustrated, an upper or longer bifurcate U-contact 101 and a lower or shorter bifurcate U-contact 102 both extending from the upper edge of a continuous base plate 103 which is centrally folded at curved segment 104 to place the planes of the two U-contact members approximately at right angles to each other. The constricted ends of the plate 103 extend slightly beyond the outer edges of the U-contacts 101 and 102 at extensions 105,106 for reasons indicated hereinafter. The bottom of the wire-receiving slot 107 between the jaws 108,109 of the upper U-contact is higher than the bottom of the slot 110 between the jaws 111,112 of the lower U-contact by a distance substantially equal to the thickness of the flat cable with which the element is to be used; and the distance between the center line of the slot 110 and the central plane of the contact 101 is equal, in the embodiment illustrated, to one and one-half times the center-to-center distance between adjacent wires of the cable. It will be understood that the width of slots 107 and 110, the length and width of jaws 108,109 and 111,112, the thickness of the metal plate of which the element is formed, and other characteristics required of spring compression reserve U-contact members will be selected in accordance with known requirements for such members.

An insulating base 120, shown in FIGS. 2–6, contains two L-shaped open cavities 121 for receiving and retaining contact elements 100. The elements fit snugly within the cavities, being held firmly in place by the end extensions 105,106 pressing against the end walls leaving space for slight spreading of the jaw members in making spring compression reserve contact. The lower contacts 102 are placed crosswise of the base with their wire receiving slots 110 on the centerline; the upper contacts 101 are thus disposed lengthwise, i.e. parallel to the longitudinal axis, and towards opposite corners of the base.

A transverse post 122 extends above the center of the base 120. The top of the post is in the form of two pyramids 123 whose adjoining edges meet at the plane of the centerline of the base. For certain specific applications a central portion of the post 122 may be eliminated, leaving a narrow central channel along the centerline.

The insulating cover 130, shown in FIGS. 7–11, likewise contains two L-shaped cavities 131 which are positioned to fit over the exposed jaw tips of the elements 100. Two transverse channels 132 cross the cover in line with the position of the wire receiving slots of the contacts 101 when the connector is assembled. The channels 132 are constricted near each end at constrictions 133 and are deepened across the constricted portions, as shown in particular in FIGS. 7, 9 and 11, for ease in inserting and retaining a connecting wire end. A central well or open cavity 136 snugly receives the post 123. Central vertical notches 137 at both ends of the cover 130 serve as sighting means permitting precise location of the piece along the desired conductor of a flat cable.

These connectors are quickly, easily, accurately and simultaneously applied to single conductors of flat cables and to connecting wire-ends. The connecting wire-ends are first laid across the channels 132 of the cover under tension sufficient to force them between the constrictions 133 and against the bottom of the channel. With the wires thus held firmly in place, the cover is placed in position against one side of the cable and by means of sighting notches 137 is centered on the desired conductor. The base, with the contact elements inserted, is applied against the opposite side of the cable in alignment with the same conductor and directly opposite the cover. Pressure is then applied, e.g. with a suitable hand tool which also serves to align the two pieces, thus forcing the two toward each other and against the cable. The two short contacts 102 make spring compression reserve contact with the conductor of the cable, which is simultaneously severed between the two as the post 122 is forced into the cavity 136. The two long contacts pass through the cable insulation between the first and second conductors adjacent the contacted conductor, and make spring compression reserve contact with the two wire ends supported in the cover. A secure connection is achieved both by the nature of the contacts and by the retaining effect of the press fit of the post 122 in the cavity 136.

Several applications of the connector of FIGS. 2–11 are indicated in FIG. 17. Connector 140 provides a T-connection between a cable conductor 141 and a looped wire 142, the loop making connection between the two contact elements and providing continuity for the severed conductor 141. Connector 143 breaks the cable conductor 144 and connects wires 145 and 146 to the severed ends. Connectors 147 and 148 have a similar fashion with respect to conductors 149 and 150 respectively, the two connecting wires 151 and 152 then serving a signal switching function between the two conductors.

Connector 153, also included in FIG. 17, is indicated as splicing the wires of a cable end 154 onto the wires of a line cable 155. As shown in more detail in FIGS. 12–16, the connector comprises a cover 156 and a base 157. Chevron-shaped open cavities 158 are provided in the base to receive the required number of twin contact elements 100, omitted here for clarity of illustration; and cooperating cavities 163 are provided in the cover. Pins 159 near the thickened ends 161 of the base fit snugly into apertures 160 in the thickened ends 162 of the cover, for alignment and retention of the same. The thickened ends 161 of the base are angled at their inner edges 164 at 45 degrees to the centerline and are spaced to receive the full width of the flat cable 155. The ends of the cover are similarly angled but in the opposite direction, to provide proper placement for the cable-ends 154.

As with the connector of FIGS. 2–11, all contacts face the same direction and only two insulating parts, viz base and cover, are required. The longer contact elements penetrate the insulation of the line cable 155 between the conductors and make contact with the conductors of the added cable 154, while the shorter elements contact the conductors of the line cable.

Maximum insulation between the longer contact element and the conductors between which it is inserted in the cable is attained by placing the element midway between and parallel to the conductors; but slight deviation from this position, for example by placing the element at an angle of up to about ten degrees to the conductors, can safely be tolerated under most conditions.

What is claimed is as follows:

1. A connector comprising an insulating base, an insulating cover, and, fixed in said base, folded bi-level twin spring compression reserve U-contact elements having their two bifurcate contact members extending to different lengths in the same direction and from the same edge of a folded base and in planes at right angles to each other.

2. Connector of claim 1 wherein each of said base and cover is channeled to provide L-shaped cavities for receiving said contact elements.

3. Connector of claim 2 wherein the top legs of said L-shaped cavities are respectively disposed transversely and longitudinally of said base and cover.

4. Connector of claim 3 wherein said cover is further channeled to provide centrally of each of said longitudinally disposed legs a transverse channel extending across said cover.

5. Connector of claim 4 wherein the walls of each said transverse channel are extended inwardly, and the depth of the channel is increased, near each end of the channel.

6. Connector of claim 1 wherein said base and cover include centrally disposed wire-severing means.

7. Connector of claim 5 wherein said base and cover include centrally disposed wire-severing means.

8. Connector of claim 2 wherein said cavities are disposed along the centerlines of said base and cover with the legs of the L each at 45 degrees to said centerline, and wherein each said base and cover includes guide means for permitting the placing of each said base and cover across a flat cable segment at an angle of 45 degrees.

9. Method of connecting a wire to an individual conductor of a flat cable comprising forcing a folded bi-level twin spring compression reserve U-contact element against said cable with the shorter U-contact making electrical contact with said conductor and the longer U-contact penetrating the cable insulation parallel to said conductor and making electrical contact with said wire lying transversely of and against said cable.

* * * * *